United States Patent [19]

Sanders

[11] 4,064,575

[45] Dec. 27, 1977

[54] BED SIDE RAILING

[76] Inventor: Antonius Hermanus Sanders, Loosdrechtseweg 38, Hilversum, Netherlands

[21] Appl. No.: 678,882

[22] Filed: Apr. 21, 1976

[30] Foreign Application Priority Data

Feb. 19, 1976 Netherlands ..... 7601661

[51] Int. Cl.[2] ..... A47C 21/00

[52] U.S. Cl. ..... 5/331; 5/100

[58] Field of Search ..... 5/100, 331; 160/215, 160/217, 225

[56] References Cited

U.S. PATENT DOCUMENTS

| | | | |
|---|---|---|---|
| 2,892,495 | 6/1959 | Hadden | 160/225 |
| 3,248,744 | 5/1966 | Hutt | 5/331 |
| 3,747,133 | 7/1973 | Hutt | 5/331 |
| 3,851,345 | 12/1974 | Benoit | 5/331 |

*Primary Examiner*—Casmir A. Nunberg

[57] ABSTRACT

A bed side railing comprising a plurality of relatively overlying beams extending in the direction of length of the bed and connected at their ends with side posts. The invention has for its object to provide a side railing of the kind set forth, which can be readily coupled and uncoupled with and from a bed respectively, while it has an efficient structure. According to the invention this can be achieved by constructing the beams coupled with the side posts by means of pivotal shafts transverse of the direction of length from two telescopic, relatively slidable portions each, and by connecting each side post near one end with the air of a rotary shaft parallel to the pivotal shafts with coupling members for coupling the side railing with a bed. In the mounted state the side railing can be readily tilted down out of its highest position into a low position in which the railing occupies comparatively little space, while in addition the length of the railing can be shortened for mounting and removing the railing by a relative displacement of the telescopically slidable beam portions.

6 Claims, 4 Drawing Figures

BED SIDE RAILING

The invention relates to a bed side railing comprising a plurality of relatively overlying beams extending in the direction of length of the bed and connected at their ends with side posts.

The conventional side railings of the kind set forth are usually coupled with the bed so as to be pivotable about pivotal axes parallel to the longitudinal axis of the bed in order to permit of tilting the side railings down. In general difficulties arise in mounting and removing the side railings and in addition the length of the railings has to match the length of the bed so that it is not easy to mount the railing on a bed of slightly differing length.

The invention has for its object to provide a side railing of the kind set forth, which can be readily coupled and discoupled with and from a bed respectively, whilst it has an efficient structure.

According to the invention this can be achieved by constructing the beams coupled with the side posts by means of pivotal shafts transverse of the direction of length from two telescopic, relatively slidable portions each and by connecting each side post near one end with the aid of a rotary shaft parallel to the pivotal shafts with coupling members for coupling the side railing with a bed.

In the mounted state the side railing can be readily tilted down out of its highest position into a low position in which the railing occupies comparatively little space, whilst in addition the length of the railing can be shortened for mounting and removing the railing by a relative displacement of the telescopically slidable beam portions.

The invention will be described more fully hereinafter with reference to an embodiment of a side railing in accordance with the invention shown schematically in the accompanying Figures.

Figure 1:
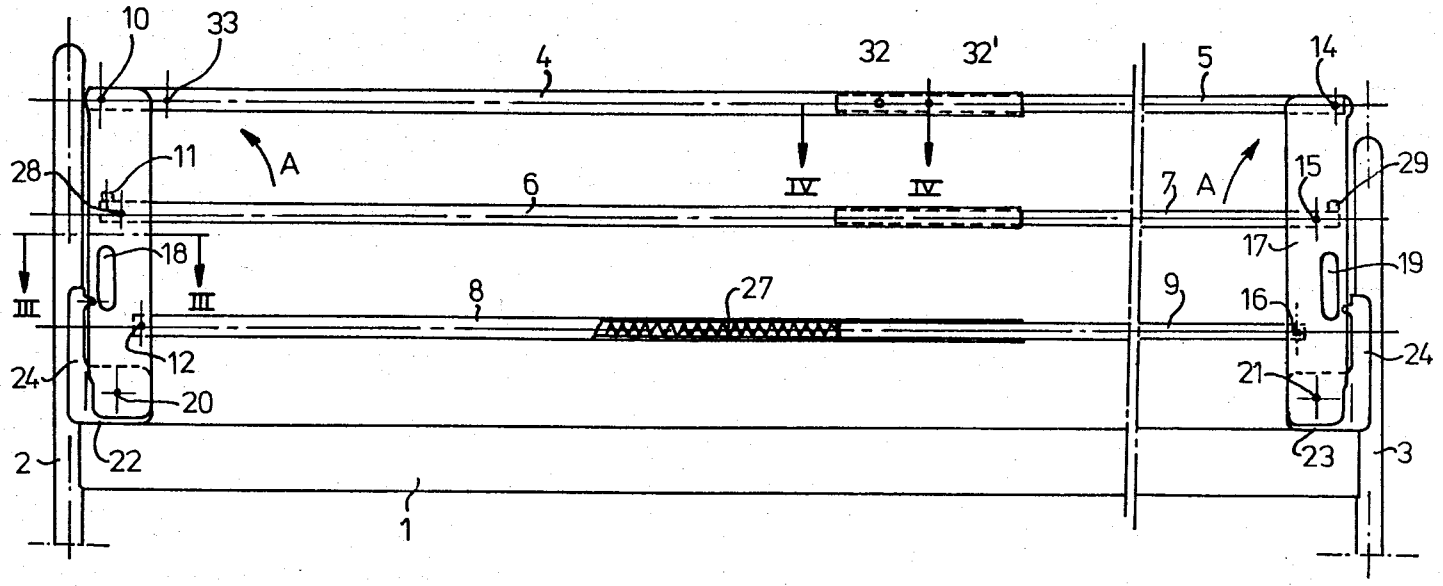
FIG. 1 is a schematic side elevation of a bed having a side railing in accordance with the invention, the railing being shown in its highest position.
Figure 2:
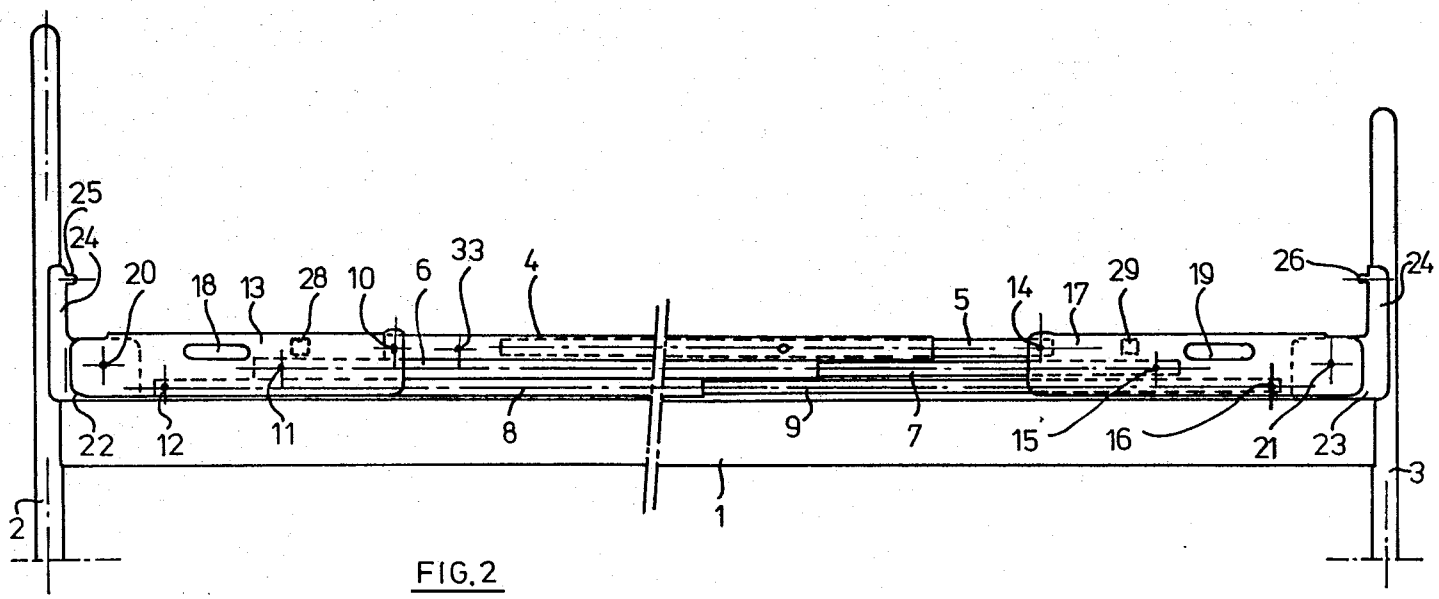
FIG. 2 is an elevational view like FIG. 1, the side railing being shown in its folded position.

FIGS. 1 and 2 show a conventional bed having a mattress-supporting frame 1 supported in a conventional manner by a head frame 2 and a foot frame 3 consisting of tubes.

The railing comprises three beams in overlying position consisting of telescopically slidable portions 4 and 5, 6 and 7, 8 and 9 respectively. The ends of the portions formed by round tubes 4, 6 and 8 remote from the portions 5, 7 and 9 formed also by round tubes are pivoted to a U-section side support 13 with the aid of pivotal shafts 10, 11 and 12 extending at right angles to the longitudinal axes of the portions 4, 6 and 8. In a similar manner the ends of the portions 5, 7 and 9 remote from the portions 4, 6 and 8 are coupled with a U-section side support 17 with the aid of pivotal shafts 14, 15 and 16. The ends of the portions 4, 6 and 8 are located between the limbs of the U-shaped support 13, whereas the ends of the portions 5, 7 and 9 are disposed between the limbs of the U-shaped support 17.

From FIG. 1 it will furthermore be apparent that in the erected position of the side railing the distance between the two pivotal shafts 10 and 14 of the topmost beam formed by the portions 4 and 5 exceeds the distance between the pivotal shafts 11 and 15 of the central beam formed by the portions 6 and 7 located beneath the topmost beam. In a similar manner the distance between the pivotal shafts 12 and 16 of the lowermost beam formed by the portions 8 and 9 of the side railing is smaller than the distance between the pivotal shafts 11 and 15. Measured in a horizontal sense the distance between the pivotal shafts 10 and 11 and the distance between the pivotal shafts 11 and 12 are at least equal to the diameter of the portions 4, 6 or 8. This also applies to the distance between the pivotal shafts 14 and 15, 15 and 16 respectively, also measrued in a horizontal sense.

From FIGS. 1 and 2 it will furthermore be seen that elongated holes 18 and 19 are provided in the limbs of the side posts 13 and 17 respectively so that these side supports can be easily taken hold of.

Near the lower ends the side supports 13 and 17 are pivotally coupled by means of pivotal shafts 20 and 21 parallel to the pivotal shafts 10 to 16 with plates 22 and 23 disposed between the limbs of the brackets. To the plates 22 and 23 are secured plated 23 and 24 respectively curved in an approximately semicircular shape and extending upwardly along the vertical tubes of the head and foot stands 2 and 3 respectively. Although this embodiment has round tubes for the head and foot strands it will be obvious that the construction described for the side railing may as well be employed with head and foot frames of square-section tubes.

The upper ends of the curved plates 23 and 24 are provided with projecting noses 25 and 26 respectively, which in the upright position of the side railing, snap into recesses in the side posts 13 and 17.

The hollow beam accommodates a compression spring 27, which tends to urge the tubes 8 and 9 away from one another.

Between the limbs of the supports 13 and 17 stops 28 and 29 are provided for co-operation with the ends of the portions 6 and 7 in the open position of the side railing shown in FIG. 1, in order to prevent the side supports 13 and 17 from tuning further in the direction of the arrow A with respect to the beams.

Figure 4:
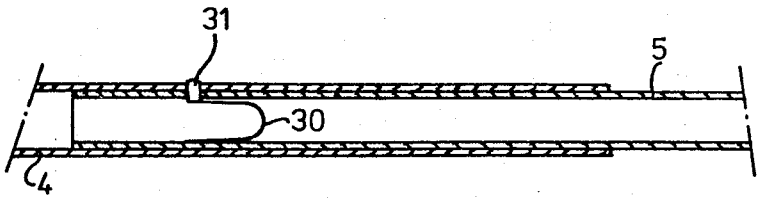
FIG. 4 is an enlarged sectional view taken on the line IV—IV in FIG. 1.
Figure 3:
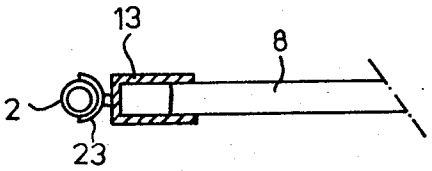
FIG. 3 is a sectional view taken on the line III—III in FIG. 1.

FIG. 4 shows that a U-shaped leaf spring 30 is provided in the end of the tube 5, a pin 31 being secured to one end thereof. Said pin is located in registering bores 32 in the tubes 5 and 4 in order to prevent a relative displacement of the tubes 4 and 5.

Out of the open position of the railing shown in FIG. 1 it can be tilted down into the position shown in FIG. 2, when the pin 31 is pushed out of the hole 32 in the tube 4 and subsequently the two side supports are turned about the shafts 20 and 21 with respect to the coupling members 22 and 23 in a direction opposite the arrow A. This turn can be performed by grasping the side supports 13 and 17 at the elongated holes 18 and 19 and by swinging them towards one another. During this pivotal movement the force of the spring 27 has to be overcome; then the telescopically slidable beam portions are slid one into the other to finally occupy the position shown in FIG. 2. For removing the side railing from the bed, when the railing is in the position shown in FIG. 2, only the two side supports 13 and 14 need be further approached to one another so that the distance between the curved plates 24 will become smaller than the distance between the head frame 2 and the foot frame 3 of the bed. In such a position the side railing can be fixed in place, since at a given instant the pin 31 will be urged by the spring 30 into a hole 33 provided in the tube 4 near the pivotal shaft 10. Obviously the railing is then locked in a position in which the distance between the two curved plates 24 is smaller than the distance between the head frame and the foot frame of a conventional bed. Mounting and tilting of a railing can be readily carried out by performing the operations described above in the inverse order.

In order to match beds of different lengths further holes 32' may be provided in the tube 4 apart from the hole 32 so that in the open position the railing can be fixed in a plurality of positions.

It will be obvious that the construction in accordance with the invention provides a side railing for a bed which can be readily mounted on and removed from a bed, whilst out of the upright position the railing can be readily tilted down into a position in which it occupies comparatively little space.

Having thus described the invention, what is claimed as new and described to be secured by letters patent is:

1. A side railing for a bed comprising:

a plurality of relatively overlying beams extending in the direction of length of the bed;

side supports;

pivotal shafts coupling said beams with said side supports, said pivotal shafts extending transverse to the longitudinal direction of said beams, each of said beams being formed from two telescopic, relatively slidable portions;

at least one spring disposed in said beams and tending to urge the two beam portions away from one another;

coupling members for coupling the side railing with a bed, said coupling members being provided with profiled parts adapted to grip partially around parts of a head and foot frame respectively of a bed; and shafts parallel to said pivotal shafts for connecting one end of each of said side supports to a respective one of said coupling members, said coupling members being held in place on said head and foot frame by the action of said spring.

2. A side railing as claimed in claim 1 characterized in that the horizontal distance between the pivotal shafts, by means of which two beams in overlying position are coupled with a side support is at least equal to the vertically measured height of a beam.

3. A side railing as claimed in claim 1 characterized in that the side supports have U-shaped sections, the ends of the beams being located between the limbs of the U-shaped side supports.

4. A side railing as claimed in claim 1 characterized in that the side supports have elongated holes.

5. A side railing as claimed in claim 1 characterized in that at least one of the beams is provided with a pin resiliently mounted in the beam, with the aid of which pin the two beam portions can be secured in a plurality of positions relative to another.

6. A side railing as claimed in claim 5 characterized in that with the aid of said pin the two portions of the beam concerned can be locked in relative positions at least in one state in which the overall length of the side railing is smaller than the distance between a head frame and a foot frame of a bed.

* * * * *